US005504419A

United States Patent [19]

Kull et al.

[11] Patent Number: 5,504,419

[45] Date of Patent: Apr. 2, 1996

[54] ROD-CORE CURRENT TRANSFORMER

[75] Inventors: Ulrich Kull, Basel; Max Friedrich, Muttenz, both of Switzerland

[73] Assignee: Moser-Glaser & Co. AG, Muttenz, Switzerland

[21] Appl. No.: 42,605

[22] Filed: Apr. 2, 1993

[30] Foreign Application Priority Data

Apr. 3, 1992 [CH] Switzerland ..... 1101/92

[51] Int. Cl.[6] ..... H01F 40/06

[52] U.S. Cl. ..... 323/358; 336/105; 336/199

[58] Field of Search ..... 336/173, 183, 336/208, 234, 199, 105, 233; 323/358

[56] References Cited

U.S. PATENT DOCUMENTS

| | | | |
|---|---|---|---|
| 2,703,390 | 3/1955 | Marks | 336/96 |
| 2,945,912 | 7/1960 | Imhof | 174/30 |
| 2,947,958 | 8/1960 | Marks | 336/84 |
| 3,187,282 | 6/1965 | Pierce et al. | 336/70 |
| 3,792,396 | 2/1974 | Panu | 336/69 |
| 3,795,881 | 3/1974 | Kalevi | 336/69 |
| 3,921,113 | 11/1975 | Schiemann | 336/84 |
| 4,032,837 | 6/1977 | Panu | 323/6 |
| 4,060,759 | 11/1977 | Panu | 323/60 |

*Primary Examiner*—Peter S. Wong
*Assistant Examiner*—Adolf Berhane
*Attorney, Agent, or Firm*—Selitto & Associates

[57] ABSTRACT

In the case of the current transformer according to the invention, the components used are arranged in a novel manner. The primary winding (7) is arranged around the secondary winding (8), with an extended core (9), at a distance which is provided for the insertion of high-voltage insulation (10). The secondary winding (8) and core (9) are located in an earthed, electrically conductive tube (12) in which the output leads of the secondary winding are connected to earth. This construction results in the avoidance of the core and windings looping around one another, which is necessary according to the prior art, is unfavourable for some applications, and is costly in manufacture.

20 Claims, 5 Drawing Sheets

ROD-CORE CURRENT TRANSFORMER

The subject-matter of the present invention is a current-measurement device for proportional conversion of a primary current at a high-voltage level into a reduced secondary current, using the induction principle. The current-measurement device is preferably used for protection and measurement purposes.

Current-measurement devices for alternating current are known, in which the current to be measured flows through a winding and transmission to a second winding takes place via whose measurement apparatuses, which are connected to the winding, a measurement of the current image takes place. Normally, the two windings are arranged concentrically on a closed iron core. FIGS. 1*a* and 1*b* show two examples of arrangements which are typically used according to the prior art. In FIG. 1*a*, a closed iron core 3 is linked by its secondary winding 1 to the high-voltage winding 2. Similarly, in the case of a loop transformer which is shown in FIG. 1*b*, the core 3, 3', with the secondary winding 7, 7', and the high-voltage winding 2 are linked to one another.

It is typical for this design that the circumstance that the iron core carrying one of the two windings surrounds the second winding, or if said second winding comprises only one conductor, this conductor.

For some applications, for example the insertion of high-voltage insulation between the two windings and their input and output leads, this circumstance is highly unfavourable since significant difficulties arise in the design of the insulation as a result of the two windings and their core surrounding one another like chain links.

Furthermore, in the case of existing designs, there is a flux in the unwound core zone which flux covers the total voltage consumption in the secondary circuit, while the flux in the winding zone of the core has a reduced value since it is partially cancelled out by the stray flux of the winding.

There are designs in which the entire core—normally an annular core—is wound such that flux homogeneity is provided over the entire core element. However, the geometric linking, with its disadvantages described above, also remains in this case.

The invention is based primarily on a novel arrangement of the components used. It is defined in the independent patent claim 1; preferred embodiments result from the dependent patent claims.

Accordingly, the primary winding is arranged round the secondary winding, with an extended iron core, at a distance which is provided for insertion of high-voltage insulation. The secondary winding and core are located in an earthed, electrically conductive tube in which the output leads of the secondary winding are passed to earth. The iron core is preferably dimensioned such that a reduction effect is produced over its entire extent as a result of the stray flux for the magnetic induction flux in the core.

This construction avoids the abovementioned geometrical looping of the core and windings around one another, which is highly unfavourable for some applications. As is shown schematically in FIG. 2, according to the invention, the rod core 9 with the one winding 8 and the other winding 6 are structures which are completely separated from one another and do not surround one another or intersect one another at any point.

The invention is intended to be explained in the following text, with reference to the attached drawings, using an exemplary embodiment in which the advantages of the novel principle are particularly evident.

FIGS. 1*a* and 1*b* show, schematically, two arrangements of the core, secondary winding and primary winding, as are typically used according to the prior art;

Figure 2:
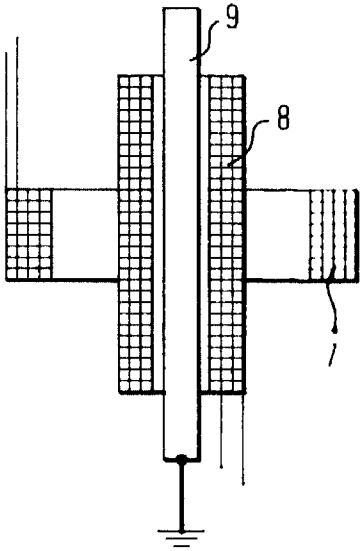
FIG. 2 shows a schematic representation of an arrangement according to the invention of the core, secondary winding and primary winding.
Figure 1A:
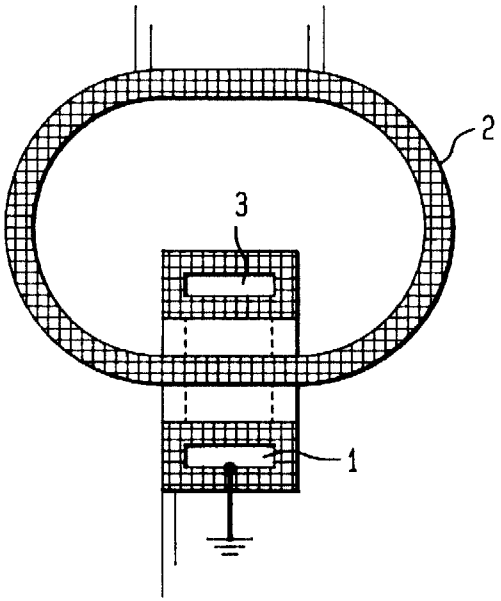
FIG. 1A (PRIOR ART)
Figure 1B:
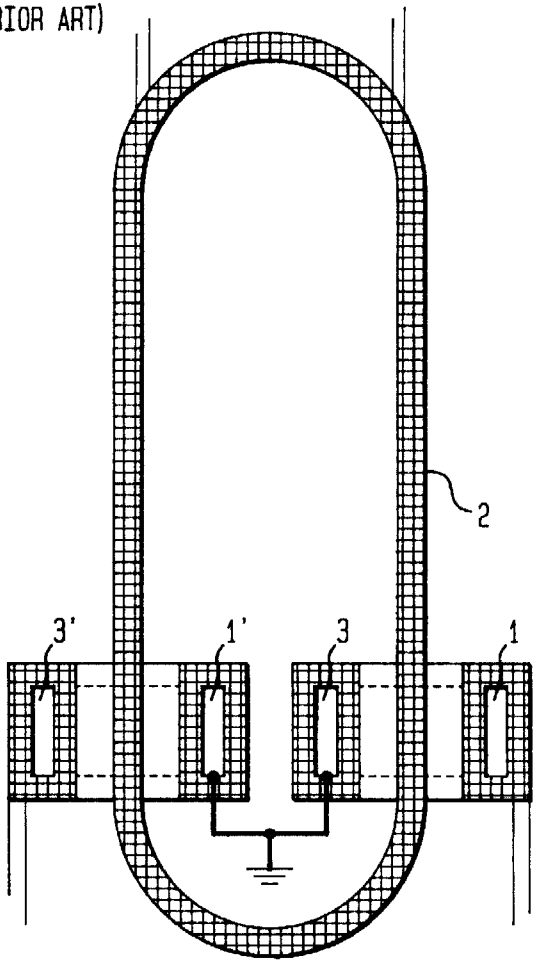
FIG. 1B (PRIOR ART)
Figure 3:
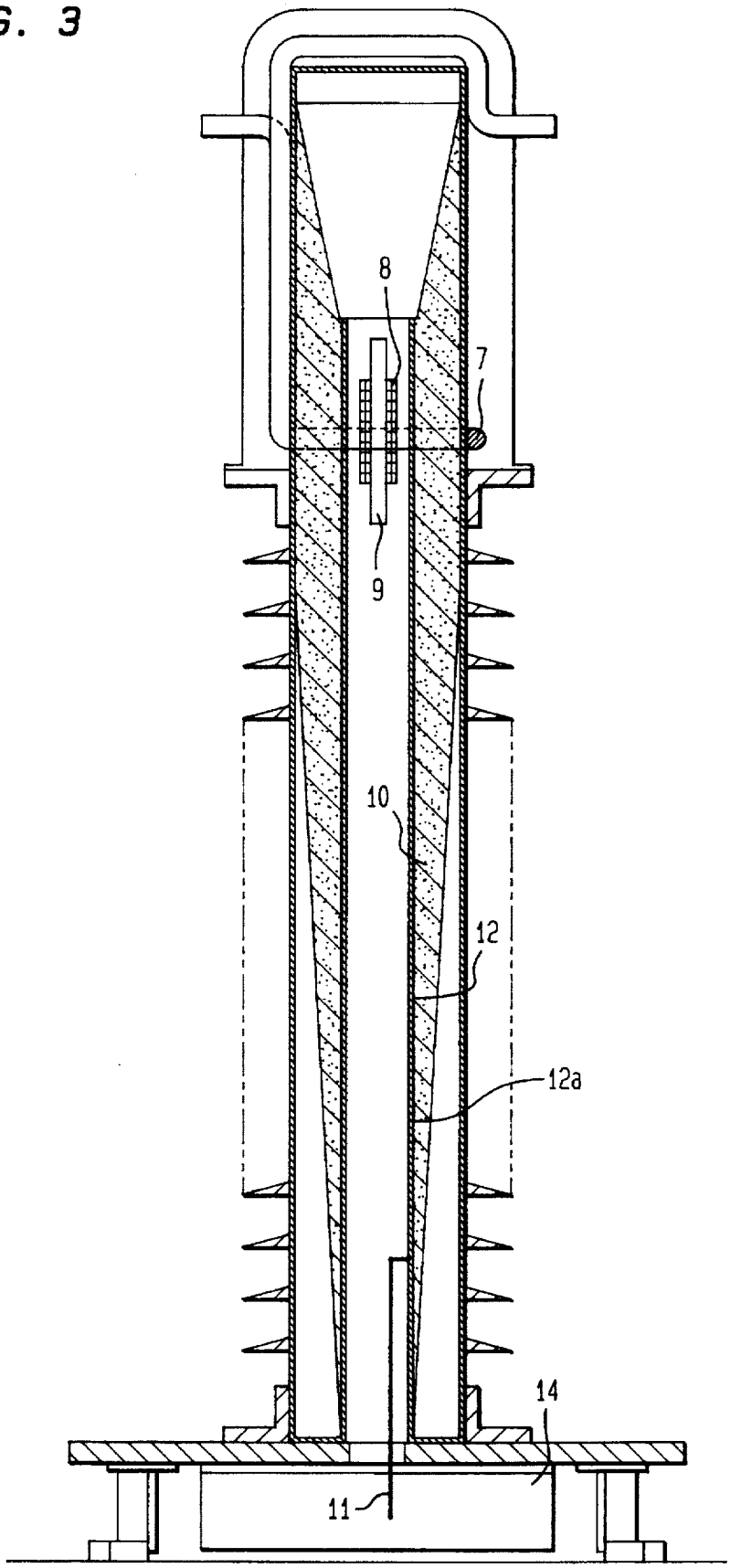
FIG. 3 shows an exemplary embodiment of the invention in a side view, with an insulator for high voltage application.

According to FIG. 3, the current transformer comprises a primary winding 7, composed of a conductor material such as copper or aluminium, which is passed around an insulating body 10 in one or more turns, and a secondary winding 8, which is composed of a conductor material such as copper and is pushed, as a coil having a number of turns corresponding to the desired current transformation ratio, over a rod core 9, which is composed of laminated, ferromagnetic material such as grain-oriented silicon steel, and, together therewith, is arranged at the level of the primary winding in an electrically conductive tube 12, which is at earth, and in which the output leads of the secondary winding are connected to earth.

In a similar manner to a high-voltage bushing, the insulating body 10 is provided with capacitive, conductive coatings for controlling the electrical field and, in the case of outdoor use, is surrounded by screens which are composed of a suitable material such as porcelain or silicon elastomer, the upper end being constructed externally as a high-voltage electrode in the region of the active transformer part, and being closed at the top. As a result of a pick-off (11) for the voltage on one (12*a*) of the capacitive intermediate coatings, which is directly opposite the tube 12, this also allows the simultaneous combination of this inductive rod-core current transformer, close to earth, with a capacitive voltage converter. The conductive control coatings and electrodes as well as the supporting tube are constructed such that they do not form a short-circuit turn in the region of the active part of the current transformer.

In addition to the active elements for current and voltage conversion, the compensation devices are also arranged at the earthed end of the supporting tube, and located in the foot 14 of the device which compensation devices are composed of known inductive, capacitive and resistive circuit elements which are possibly required in order to correct the transformation error and phase shift. In order to short-circuit the measurement load in the high-current range, this load is connected in parallel with a saturable inductor. The active elements of the current transformer or voltage converter are dimensioned such that sufficient power is available for the interference-free transmission of the measurement signals and for reliably driving electronic protection relays and measurement devices.

Figure 4:
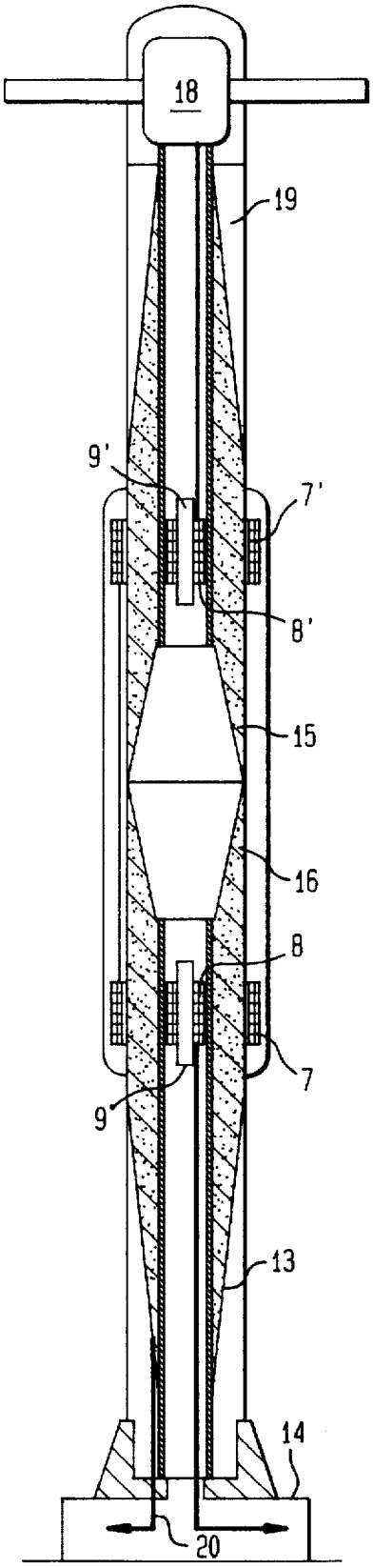
FIG. 4 shows interconnection to form a cascade.

FIG. 4 shows how two (or possibly also a plurality of) the above-described devices can be connected together to form a cascade (in this case having two stages). The two short-circuited elements 15 and 16 of the insulating bodies are located opposite one another. The dissipation of the medium voltage to earth or of the high voltage which is to be measured to the medium potential takes place via the elongated elements 13 and 19 of the insulating bodies respectively. A coupling winding 7, 7' ensures magnetic coupling of the two wound rod cores. The upper cascade element is supplied via a current transformer 18 in the high-voltage line which is to be measured. This transformer is permanently connected to the upper cascade element. The high voltage can be measured in a known manner, via a resonant inductor and intermediate converter, via a conductive measurement coating 20 which is passed out and is close to earth. The various compensation elements and the elements for voltage measurement are located in the foot 14 of the cascade.

Figure 5:
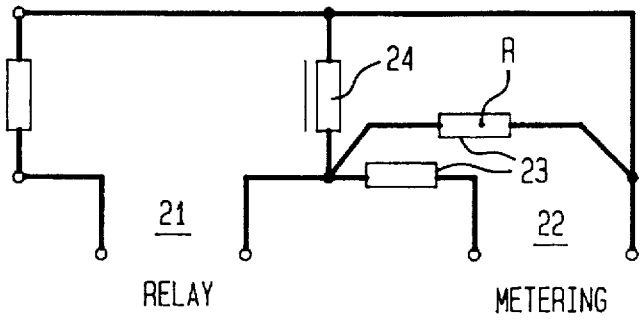
FIG. 5 shows a scheme of a secondary circuit with a relay connection and measurement connection.

FIG. 5 shows a scheme of a secondary circuit having a separate relay connection 21 and metering connection 22. The measurement connection 22 has a compensation circuit 23 for correction of the phase shift. An inductor 24, which has an iron core and bridges the metering connection 22 and the compensation circuit 23, is dimensioned such that it saturates in the overcurrent region and hence relieves the load on the secondary circuit.

Figure 6:
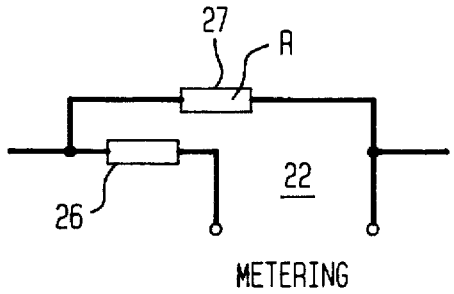
FIG. 6 shows a measurement connection with a compensation circuit.

FIG. 6 shows the metering connection 22 with its compensation circuit. The latter comprises a linear inductor 26, which is connected upstream of the metering connection, and a resistor 27 which is connected in parallel with the series circuit of the metering connection and inductor. The corresponding adjustment of the value of the resistor allows the desired correction of the phase shift in both directions.

Figure 7:
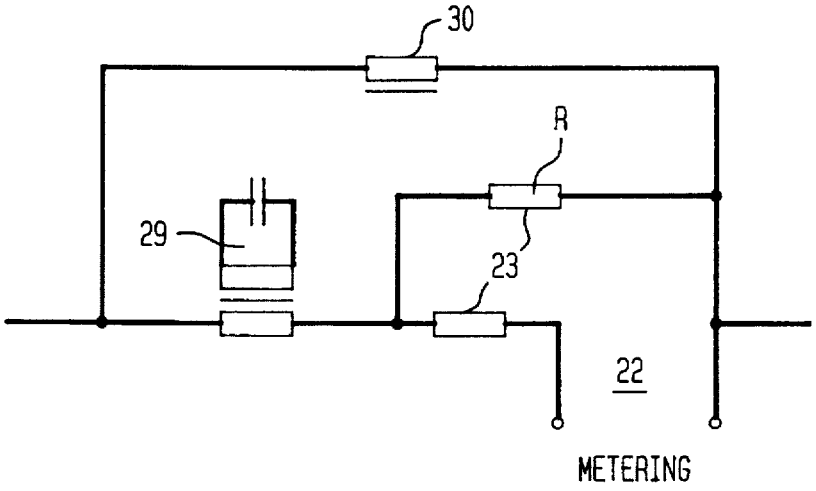
FIG. 7 shows a scheme for compensation of an inductance which is used for phase-shift correction.

In order to keep the load on the secondary circuit of the current transformer low, compensation of the inductor, which is required for the phase-shift correction, is advantageously carried out by means of a capacitor 29, in accordance with FIG. 7. In the over-current region, the capacitor 29 and the compensation circuit 23 with the load connection are shorted to the iron core, by means of a parallel-connected inductor 30 which is dimensioned such that it is saturated in this region. In consequence, the secondary circuit is effectively relieved of load in the event of a short-circuit current being transmitted.

Figure 8:
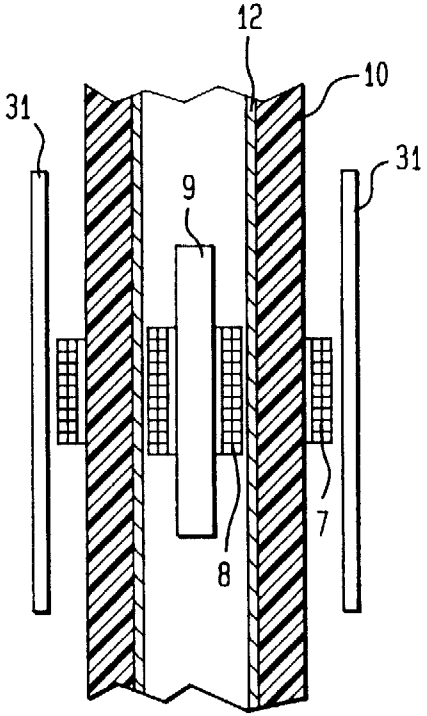
FIG. 8 shows the arrangement of additional elements composed of magnetic material.

According to FIG. 8, the magnetic circuit is additionally influenced in the desired sense by the fitment of rods or metal sheets 31, composed of magnetic materials, radially outside the primary winding 7, as a result of which effective protection against magnetic external interference is achieved at the same time.

Figure 9:
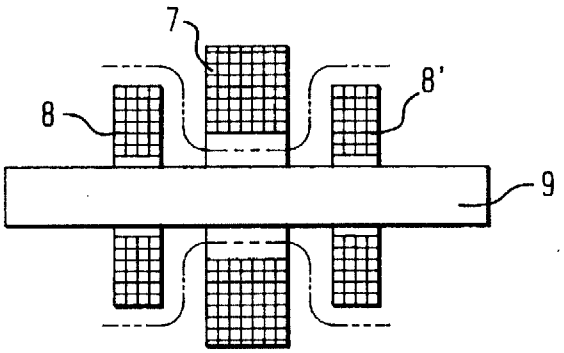
FIG. 9 shows an arrangement having an interleaved primary winding and secondary winding.

In special cases, it is possible, as is shown in FIG. 9, for the primary winding 7 and the secondary winding 8, 8' to be interleaved, as a result of which an arrangement for precision measurements is provided, on the basis of the linear response of the rod core.

Figure 10:
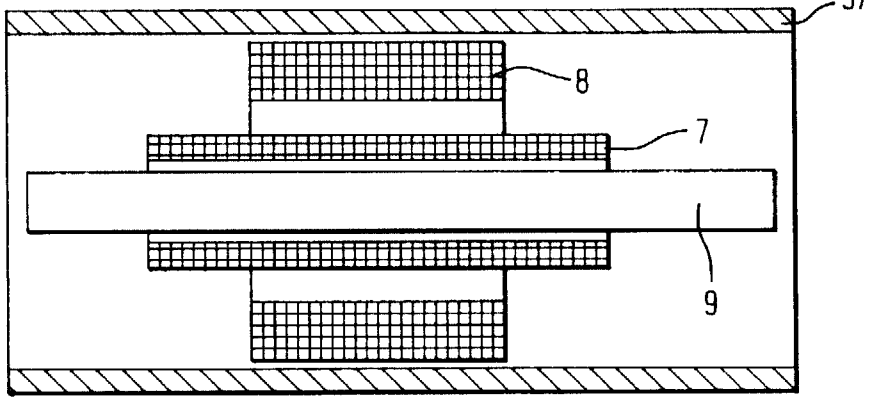
FIG. 10 explains the capability for interchanging the high-voltage winding and low-voltage winding.

Furthermore, an arrangement is also possible in which the positions of the high-voltage winding and of the low-voltage winding are interchanged. In the case of the arrangement shown in FIG. 10, a low-voltage winding 8 is located externally, while a high-voltage winding 7 is arranged on the rod core 9. The entire structure is surrounded by a magnetic screen 37 which is used for field control and for screening against external fields.

The use of capacitively controlled high-voltage insulation provides the capability, as mentioned, to pass a conductive measurement coating out close to earth and thus to measure the voltage in a manner known per se, via a resonant inductor and a medium-voltage converter, so that a combined measurement device for current and voltage is provided.

The most significant advantages of the current-measurement device according to the invention can be summarised as follows:

Very simple arrangement of the components of the transformer, which arrangement simplifies its production and assembly and ensures robustness with respect to transportation stresses, and high operating reliability.

Particularly simple construction of the high-voltage insulation in the form of a cylindrical capacitor bushing without any particular production difficulties, as are typical, for example, for the insulated guidance of the primary turns in the tank current transformer or passing the secondary connections out in a screened manner in the top-winding current transformer.

In the case of the use of solid insulation, complete maintenance freedom (neither insulating oil nor insulating gas to be inspected) and environmental compatibility (impossible for any liquid or gas to emerge).

No risk of fires in the case of a design with gas or solid insulation.

We claim:

1. Current-measurement device for the proportional conversion of a primary current at a high-voltage level into a reduced secondary current, using the induction principle, characterized in that an extended rod core (9) having an associated secondary winding (8) is arranged in an electrically conductive tube (12) in such a manner that its output leads of the secondary side pass directly through the tube (12) to a transformer load, and a primary winding (7), which comprises at least one turn or winding, is arranged at a distance around the secondary winding (8) in such a manner that there is space for high-voltage insulation (10) between the two windings (7,8), wherein said rod core (9) dimensioned such that the main flux and the magnetic stray flux largely cancel one another out in its cross-section.

2. Current-measurement device according to patent claim 1, characterised in that the rod core (9) is composed of laminated magnetic sheet metal.

3. Current-measurement device according to patent claim 1, characterised in that the rod core (9) is composed of amorphous iron in glass-metal form and is laminated in a similar manner to that of magnetic sheet material.

4. Current-measurement device according to one of patent claims 1 to 3, characterised in that the rod core (9) is constructed as a stack or in radial or involute metal sheeting.

5. Current-measurement device according to claim 1, characterised in that the tube (12) which surrounds the rod core (9) with the secondary winding (8), is provided with slots and/or interruptions in order to suppress the formation of eddy currents or a short-circuit turn.

6. Current-measurement device according to claim 1, characterised in that the secondary winding (8) of the rod core (9) is constructed from a plurality of parallel-connected branches in order to influence the field.

7. Current-measurement device according to claim 1, characterised in that, in addition to the secondary winding (8), an additional winding is constructed, which comprises a plurality of parallel-connected branches in order to influence the field.

8. Current-measurement device according to claim 1, characterised in that the high-voltage insulation (10) between the primary winding (7) and the secondary winding (8) is composed of oil or solid insulation or sulphur-hexafluoride gas.

9. Current-measurement device according to claim 1, characterised in that the said device is constructed as a suspension insulator for a high-voltage line.

10. Current-measurement device according to claim 1, characterised in that the said device is integrated in a gas-encapsulated switching installation (GIS).

11. Current-measurement device according to claim 1, characterised in that two or more transformers are connected in cascades.

12. Current-measurement device according to patent claim 11, characterised in that the cascade element connected to high voltage is supplied via a current transformer (18) which is located in the line run of the current to be measured and is permanently connected to this cascade element.

13. Current measurement device according to claim 1, characterized in that the circuit on the secondary side of the current transformer, on the earth side, is constructed such that a relay connection (21) and a metering connection (22) are passed out separately the metering connection (22) being provided with a compensation device (23) and the metering connection (22) and the compensation device (23) being bridged by an inductor (24) having an iron core and the inductor (24) being designed such that it saturates in the overcurrent region so that, in the short-circuit measurement region of the transformer, the secondary circuit is relieved of load with respect to its load.

14. Current-measurement device according to claim 13, characterized in that the metering connection (22) is provided with a compensation device (23) which is preferably used for phase-shift compensation.

15. Current-metering device according to patent claim 14, characterised in that the compensation device (23) comprises a linear inductor (26), which is connected in series with the measurement connection (22), and a resistor (27), which is connected in parallel with the said series circuit (22, 26) and, set in a suitable manner, causes the desired correction of a phase shift in the positive or negative direction.

16. Current-measurement device according to patent claim 15, characterised in that the inductor (26), which is required for phase-shift compensation and is connected in series with the measurement load, is compensated for by means of a capacitor (29), which is connected to a matching transformer and is connected in series with the metering circuit (22) and inductor (26), so that the compensation inductance does not represent any load on the secondary circuit of the transformer and, at the same time, the relief of the load on the secondary circuit in the overcurrent region is also extended to the capacitor (29), as a result of the connection of a saturable inductor (30) in parallel with the capacitor (29), the compensation inductor and the measurement load.

17. Current-measurement device according to claim 1, characterized in that the primary winding (7) and the secondary winding (8, 8') are constructed in an interleaved manner so that the current-measurement device is suitable in particular for precision measurement, as a result of its characteristic linearity.

18. Current-measurement device according to claim 1, characterized in that the high-voltage insulation (10) is controlled in a capacitive manner, by means of conductive intermediate coatings, for voltage dissipation, which do not form any short circuit winding.

19. Current-measurement device according to patent claim 18, characterised in that one (20) of the intermediate coatings is passed out close to earth potential, for voltage measurement.

20. Current-measurement device according to claim 1, characterised in that the high-voltage winding is arranged internally around the core, and the low-voltage winding is located externally.

* * * * *

UNITED STATES PATENT AND TRADEMARK OFFICE

CERTIFICATE OF CORRECTION

PATENT NO. : 5,504,419

DATED : April 2, 1996

INVENTOR(S) : Ulrich Kull et al.

It is certified that error appears in the above-identified patent and that said Letters Patent is hereby corrected as shown below:

Column 2, line 19, after "3, the", insert --active part of the--.
Column 4, line 30, after "(9)", insert --is--.

Signed and Sealed this

Tenth Day of December, 1996

*Attest:*

*Attesting Officer*

BRUCE LEHMAN

*Commissioner of Patents and Trademarks*